US006557910B2

(12) United States Patent
Amano

(10) Patent No.: US 6,557,910 B2
(45) Date of Patent: May 6, 2003

(54) DOOR LOCK DRIVE UNIT

(75) Inventor: Hitoshi Amano, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/987,797

(22) Filed: Nov. 16, 2001

(65) Prior Publication Data

US 2002/0063430 A1 May 30, 2002

(30) Foreign Application Priority Data

Nov. 27, 2000 (JP) ..... 2000-359641
Aug. 3, 2001 (JP) ..... 2001-236529

(51) Int. Cl.[7] ..... E09C 3/12
(52) U.S. Cl. ..... 292/201; 292/216; 292/DIG. 23
(58) Field of Search ..... 292/201, 216, 292/DIG. 23

(56) References Cited

U.S. PATENT DOCUMENTS 5,934,717 A * 8/1999 Wirths et al. ..... 292/201
6,114,821 A * 9/2000 Kachouh ..... 318/466
6,145,354 A * 11/2000 Kondo et al. ..... 70/279.1
6,155,124 A * 12/2000 Wirths ..... 74/89.13
6,278,252 B1 * 8/2001 Kachouh ..... 318/466
6,371,538 B1 * 4/2002 Inoue ..... 292/216
6,390,517 B1 * 5/2002 Ehret ..... 292/201

FOREIGN PATENT DOCUMENTS

JP A-10-159412 6/1998

* cited by examiner

*Primary Examiner*—Teri Pham Luu
*Assistant Examiner*—André L. Jackson
(74) *Attorney, Agent, or Firm*—Law Offices of David G. Posz

(57) ABSTRACT

A rotating speed of the motor 4 is reduced at a high reduction ratio by using a reduction gear (the first and the second reduction gear), and the unlatch mechanism for conducting unlatch operation of the door lock 1 and the closer mechanism for conducting closer operation of the door lock 1 are separated from each other by the normal and the reverse rotating direction of the second reduction gear. Due to the foregoing, even in the middle of a closing operation conducted by the reverse rotation of the second reduction gear, when the closing operation is stopped and then the motor 4 is normally rotated, it is possible to switch from the stopping position of the closing operation to unlatch operation.

17 Claims, 8 Drawing Sheets

DOOR LOCK DRIVE UNIT

BACKGROUND OF THE INVENTION

1. Field of the Invention

The present invention relates to a door lock drive unit. More particularly, the present invention relates to a door lock drive unit in which an unlatch mechanism for releasing a door lock engagement mechanism and a closing mechanism for closing a latch from a half latch state to a full latch state are composed of one motor.

2. Description of the Related Art

Conventionally, there is provided a door lock drive unit for vehicle use in which one motor conducts an unlatch function to unlatch a latch from a door closing state to an unlatch state by rotating the motor normally and also conducts a closing function to close the latch from an incomplete door closing state (half latch state) to a door closing state (full latch state) by reversing the motor.

The door lock drive unit must have a large-ratio reduction gear which is housed in an actuator and conducts a closing function using a drive force generated by a motor because it is necessary to provide a large torque in the case of a closing operation and also it is necessary to conduct the closing operation slowly. In this connection, the reason why it is necessary to conduct the closing operation slowly is described below. If the closing operation is conducted quickly, the following problems may be encountered. When it is necessary to stop a closing motion of a door in the case of emergency in which a finger is pinched by the door, it takes time to stop the closing motion and even if a sensor, to detect a finger, is provided, a time lag necessarily occurs from the time of detection by the sensor to the time of stopping of a motor. When a large-ratio reduction gear is incorporated into the actuator of the prior art, the size of the door lock drive unit is increased.

In the case of emergency in which a finger is pinched by the door in the middle of closing operation (in the process from a door open state to a door closed state), it is required that the closing operation is stopped and the stopping position of the closing operation is changed over to the unlatch operation (door opening motion) even in the middle of closing operation.

SUMMARY OF THE INVENTION

In view of the above problems, it is an object of the present invention to provide a door lock drive unit capable of conducting both the unlatch function and the closing function using one motor, characterized in that: the size of the door lock drive unit can be reduced; and safety can be ensured in the case of emergency in which a finger is pinched.

In order to solve the above problems, the door lock drive unit of the present invention operates as follows. Rotation of an output shaft of one motor, which is normally rotated and reversed, is reduced by a reduction gear and rotates an engagement member and an output cam. When the motor normally rotates the engagement member and the rotation is transmitted to the first output shaft, the first output shaft activates the door lock and conducts unlatch operation (unlatch function). Also, when the motor reverses, the output cam and the rotation is transmitted to the second output shaft, the second output shaft activates the door lock and conducts a closing operation (closing function).

As described above, a unlatch mechanism and a closing mechanism, in which unlatch operation and closing operation are separately conducted by the normal and the reverse rotation of the gear unit, are provided. Even in the middle of a closing operation conducted by the reverse rotation of the gear unit, the closing operation is stopped (The motor is stopped.), and then, when the motor is normally rotated, it is possible to change over from the stopping position of the closing operation to the unlatch operation (door opening operation). Due to the foregoing, it is possible to reduce the size of a door lock drive unit capable of conducting both the unlatch function and the closing function by one motor and, further, safety can be ensured in the case of an emergency in which a finger is pinched.

The present invention may be more fully understood from the description of preferred embodiments of the invention, as set forth below, together with the accompanying drawings.

BRIEF DESCRIPTION OF THE DRAWINGS

In the drawings:

FIGS. 3A to 3C are schematic illustrations for explaining unlatch operation of the closing and unlatch actuator of the first embodiment of the present invention, wherein FIG. 3A is a view before a door is opened (A door is completely closed.), FIG. 3B is a view of an unlatch state (A door can be opened.), and FIG. 3C is a view showing an open state of the door;

FIGS. 5A and 5B are schematic illustrations for explaining closing operation of the closing and unlatch actuator of the first embodiment of the present invention, wherein FIG. 5A is a view before a door is closed (a state of half latch), and FIG. 5B is a view of full latch (the door is completely closed);

FIGS. 7A and 7B are circuit diagrams showing a door lock control circuit by which the state is changed from a door closing state to a door open state via an unlatch state, wherein FIG. 7A is a circuit diagram showing a state of connection in which a motor is normally rotated so as to obtain an unlatch state, and FIG. 7B is a circuit diagram showing a state of connection in which the motor is reversed so as to obtain a neutral state (open door state);

FIGS. 8A and 8B are circuit diagrams showing a door lock control circuit by which the state is changed from a door open state to a door closed state via a half latch state or full latch state, wherein FIG. 8A is circuit diagram showing a state of connection in which the door is closed from an door open state and the motor is reversed from a state of half latch, and FIG. 8B is circuit diagram showing a state of connection in which the door is closed and electric power to the motor is stopped;

FIGS. 10A and 10B are schematic illustrations for explaining the closing operation of the closing and unlatch actuator of the second embodiment of the present invention, wherein FIG. 10A is a view before a door is closed (state of half latch), and FIG. 10B is a view of full latch (the door is completely closed)

DESCRIPTION OF THE REFERRED EMBODIMENTS

Referring to the accompanying drawings, a plurality of embodiments of the present invention will be explained below.

FIRST EMBODIMENT

Referring to the accompanying drawings, a door lock drive unit of the first embodiment of the present invention will be explained in detail. In this connection, in the door lock drive unit explained below, the structure of the closing and unlatch actuator is devised, so that one motor can perform both the unlatch function and the closing function, and further while the size of the door lock drive unit is reduced, safety can be ensured in the case of an emergency in which a finger is pinched.

Figure 1:
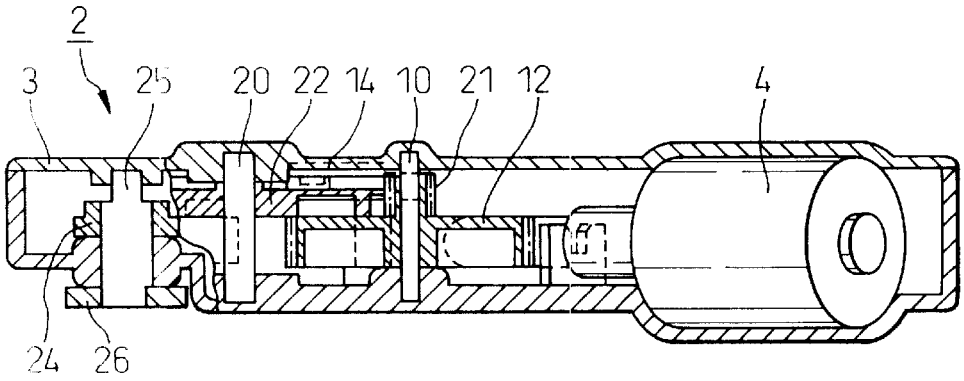
FIG. 1 is a cross-sectional view showing a structure of a closing and unlatch actuator of the first embodiment of the present invention.
Figure 2:
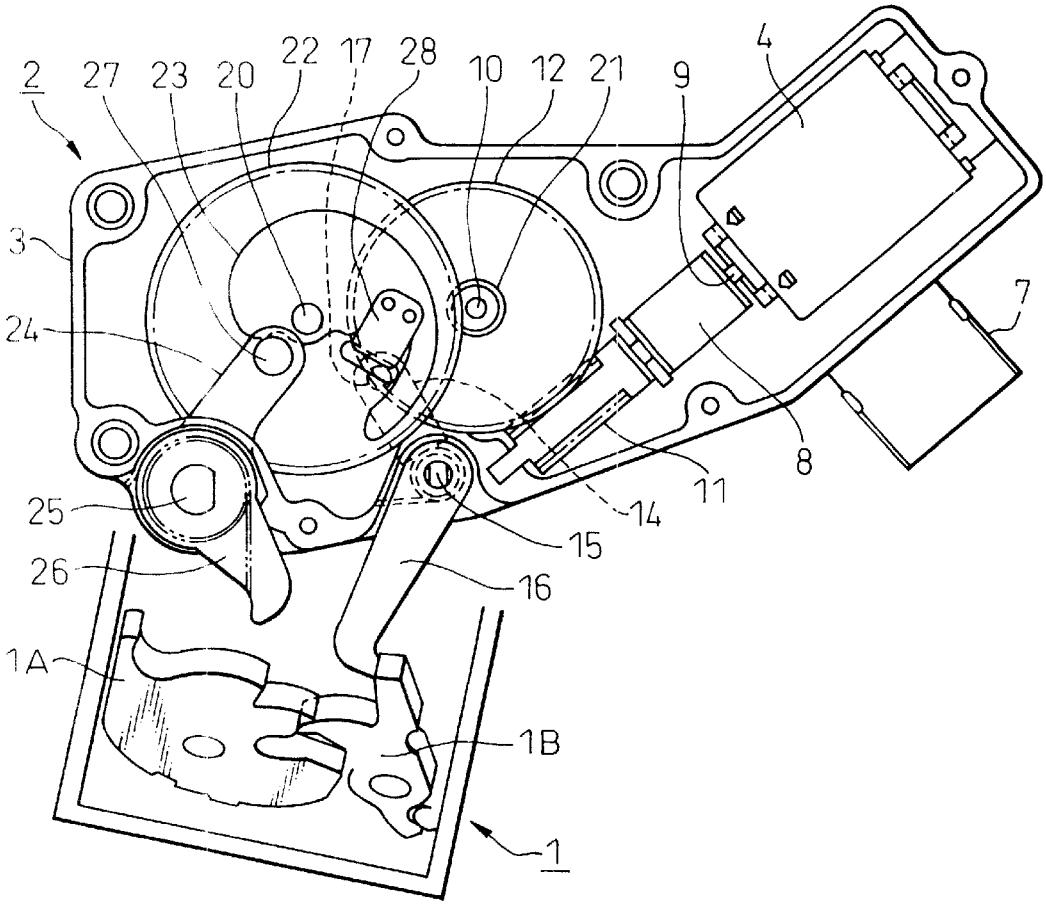
FIG. 2 is a plan view showing the structure of the closing and unlatch actuator of the first embodiment of the present invention.

FIGS. 1 and 2 are views showing a structure of the closing and unlatch actuator 2 of the first embodiment of the present invention. The door lock drive unit used for a vehicle such as an automobile of the present embodiment includes: a door lock 1 to keep a door of a vehicle such as an automobile closed; a closing and unlatch actuator 2 containing both the unlatch mechanism for releasing an engagement mechanism of the door lock 1 and the closing mechanism for operating a latch from a half latch state to a full latch state; and a door lock control circuit 5 for controlling electrification and stoppage of the electrification to one motor 4 housed in the actuator 2.

The door lock 1 includes an engagement mechanism for engaging with and separating from a striker (not shown) attached to a door receiver of a vehicle body. When an open door is closed, the open door state is changed to a closed door state via a half latch state or a full latch state. When a closed door is opened, the closed door state is changed to an open door state via an unlatch state.

The engagement mechanism of the door lock 1 is an engagement and disengagement mechanism composed of a latch 1A and a ratchet 1B capable of forming one of the following three states. They are: a half latch state (half lock: a state in which the door is not completely closed) in which the striker is held in the case of an incomplete locking state; a full latch state (full lock: a state in which the door is completely closed) in which the striker is held in the case where the door is closed; and an unlatch state (a state in which the door can be opened) in which the striker can be released.

The closing and unlatch actuator 2 includes: an actuator case 3; a motor 4; a first and a second reduction gear (described later) composing a reduction device; an engagement member 28; an output cam 23; and first and second output shafts 15, 25. The actuator case 3 is made of an electrically insulating resin and integrally formed into a predetermined shape. In this actuator case 3, components of the closing and unlatch actuator 2 are housed. At an end portion of the actuator case 3, there is integrally provided a connector shell 7 engaging with a connector (not shown) on an external conductor side.

The motor 4 is provided with a rotary shaft 9 capable of rotating in the normal and reverse direction. In the case of an unlatch operation, a control signal is given the motor 4 by the door lock control circuit 5 and generates torque in the normal rotating direction in the first reduction gear. In the case of closing operation, a control signal is given the motor 4 by the door lock control circuit 5 and generates torque in the reverse rotating direction in the first reduction gear. In this connection, the above shaft 9 and the first reduction gear are connected with each other via the elastic body 8 which absorbs and damps vibration generated when the shaft 9 is rotated at high speed, so that the vibration is prevented from being transmitted to the first reduction gear.

The first reduction gear reduces a rotating speed of the motor 4 at a predetermined reduction ratio. The first reduction gear includes: a motor pinion gear 11 made of resin fixed to an outer circumference of the shaft 9 of the motor 4; and a first reduction gear 12 made of resin meshed with this motor pinion gear 11. In this connection, the first reduction gear 12 is pivotally engaged with the central shaft 10, both ends of which are fixed to the top wall section and the bottom wall section of the actuator case 3.

The second reduction gear reduces a rotating speed of the motor 4 at a predetermined reduction ratio, that is, the second reduction gear reduces a rotating speed of the first reduction gear 12 at a predetermined reduction ratio. The second reduction gear includes: an intermediate pinion gear 21 made of resin arranged on one end face of the first reduction gear 12; and a second reduction gear 22 made of resin meshed with this intermediate pinion gear 21. In this connection, the second reduction gear 22 is pivotally engaged with the central shaft 20, both ends of which are fixed to the top wall section and the bottom wall section of the actuator case 3.

The output cam 23 is integrally arranged on the end face of the second reduction gear 22. The output cam 23 is formed into a convex shape by which the second operation lever 24 connected with the second output shaft 25 can be moved in the closing direction. To be specific, the cam face of the output cam 23 includes: a side wall face (cam wall) coming into contact with the second operation lever 24 at the neutral position; an outer wall face (cam face) to move the second operation lever 24 in the closing direction in the case of closing operation; and an inner wall face (cam wall) by which the second operation lever 24 can pass through the output cam 23 in the case of unlatch operation. In this connection, the outer wall face is formed into a curved face, the radius of curvature of which is determined so that the outer diameter can be gradually increased around the central shaft 20.

Figure 4:
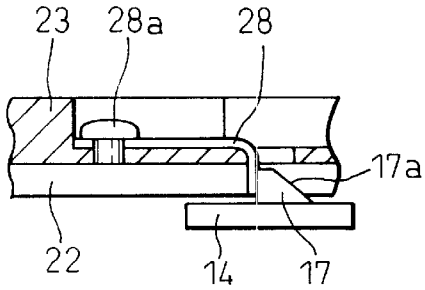
FIG. 4 is a partially cross-sectional view taken in the direction of arrow A in the unlatch operation schematic illustration shown in FIG. 3B.

The engagement member 28 is arranged separately from the second reduction gear 22 on an end face of the second reduction gear 22 which is located on the same side as the side on which the output cam 23 is integrally formed. This engagement member 28 is an elastic metal sheet-shaped spring member and is formed into an L-shape by means of bending. This engagement member 28 is fixed to an end face of the output cam 23, which is substantially parallel with an end face of the second reduction gear 22, with the screw 28*a* as shown in FIG. 4. An end portion of this L-shaped engagement member 28 is protruded onto a side of the second reduction gear 22, which is opposite (reverse) to the side on which the engagement member 28 of the second reduction gear 22 is arranged, via a hole formed penetrating the end face of the second reduction gear 22.

Since the engagement member 28 is composed as described above, when the second reduction gear 22 is normally rotated, the engagement member 28 is engaged with the first operation lever 14 connected with the first output shaft 15, described later, on one end face of the second reduction gear 22 (on the side opposite to the side on which the engagement member 28 is arranged), so that the first operation lever 14 can be moved in the unlatch direction. That is, both the first operation lever 14 and the engagement member 28 are engaged with each other so that they can be engaged with the first operation lever 14 only when the second reduction gear is normally rotated. Even when the second reduction gear is reversed by one revolution from this engagement position and the engagement member 28 and the first operation lever 14 come to a contact position, the engagement member 28 is not engaged with the first operation lever 14 because the elastic engagement member 28 is bent.

The engagement mechanism of the engagement member 28 with the first operation lever 14 is composed as follows. The first pin section 17, the profile of which is substantially a column, is integrally formed at an end of the first operation lever 14 made of resin, and the tapered face 17*a* (shown in FIG. 4) is formed at a head section of the first pin 17. Due to the above structure, by the contact of this first pin section 17 with the L-shaped end portion of the protruding engagement member 28, the engagement between them can be accomplished in only one direction. That is, even when the second reduction gear is reversed and the engagement member 28 comes into contact with the first pin section 17 in the direction of the tapered face 17*a,* the engagement member 28 is bent and moves over the tapered face 17*a* while the engagement member 28 is sliding on the tapered face 17*a.* Therefore, it is possible to avoid the engagement with the first operation lever 14. On this other hand, when the second reduction gear is normally rotated and the engagement member 28 comes into contact with the first pin section 17 in the opposite direction to the tapered face 17*a,* the engagement member 28 and the perpendicular face of the first pin section 17 are contacted with each other so that the engagement can be accomplished.

The first output shaft 15 has a first operation lever 14, made of resin, which is engaged with the engagement member 28. One end of the first output shaft 15 is pivotally supported by the bearing section of the actuator case 3, and the other end of the first output shaft 15 is protruded outside from the actuator case 3. In this connection, the lever body of the first operation lever 14 is arranged at such a height that the lever body cannot interfere with the output cam 23. In this connection, a small play is provided between the first operation lever 14 and the first output shaft 15 in the rotary direction.

The second output shaft 25 has the second operation lever 24 made of resin engaging with the output cam 23. One end of the second output shaft 25 protruded outside from the actuator case 3, and the other end thereof is pivotally supported by the bearing section of the actuator case 3. At an end of the second operation lever 24, the second pin section 27, the profile of which is substantially a column, engaging with the output cam 23 is integrally formed. In this connection, the lever body of the second operation lever 24 is arranged at such a height that the lever body cannot interfere with the output cam 23.

The unlatch output lever 16 corresponds to the first output lever of the present invention. The unlatch output lever 16 is formed into a predetermined shape by means of integral resin molding and fixed to an outer circumference of the first output shaft 15. In this connection, a return spring to return the unlatch output lever 16 from the unlatch position to the neutral position may be attached at a position between the unlatch output lever 16 and the actuator case 3.

The closing output lever 26 corresponds to the second output lever of the present invention. The closing output lever 26 is formed into a predetermined shape by means of integral resin molding and fixed to an outer circumference of the second output shaft 25. In this connection, a return spring to return the closing output lever 26 from the closing position to the neutral position may be attached at a position between the closing output lever 26 and the actuator case 3.

The door lock control circuit 5 is composed of a microcomputer (motor control means) having CPU, ROM and RAM. The door lock control circuit 5 supplies electric power to the motor 4 so that the motor 4 can be rotated in the normal or reverse direction according to ON/OFF signals sent from the following various switches. The switches are: a door opening switch 31 manually operated by a passenger; a half latch switch 32 to detect a half latch state; a microswitch (unlatch switch: unlatch position detecting means) 33 to detect the unlatch state and the neutral position of the second reduction gear 22; and a microswitch (closing switch: closing position detecting means) 34 to detect that the second reduction gear 22 and the second output cam 23 have rotated in the closing direction by one revolution.

Next, operation of the door lock drive unit will be explained below. In this case, FIGS. 3A to 6 are views for explaining operation of the closing and unlatch actuator 2, and FIGS. 7A, 7B, 8A, 8B are views showing the door lock control circuit 5. When a passenger turns on the door opening switch 31 so as to open the door, an electric current flows in the electric circuit 6 of the motor 4 in the direction shown in FIG. 7A, and the motor 4 is normally rotated. Torque of the motor 4 is transmitted to the pinion gear via the elastic body 8 and further transmitted to the intermediate pinion gear 21 via the pinion gear and the first reduction gear 12. When the second reduction gear 22 and the engagement section 28 are rotated in the clockwise rotating direction (normal rotating direction), the engagement member 28 and the first pin section 17 come into contact and engage with each other. This engagement state is shown in FIG. 4. FIG. 4 is a partially cross-sectional view taken in the direction of arrow A in the schematic illustration to explain the unlatch motion shown in FIG. 3B.

Due to the foregoing, the first pin section 17 is moved in the clockwise rotating direction while it keeps an engagement with the engaging member 28, and the first operation lever 14 is rotated in the counterclockwise rotating direction around the first output shaft 15. As the first operation lever 14 and the unlatch output lever 16 are fixed to an outer circumference of the first output shaft 15, when the first operation lever 14 is rotated, the unlatch output lever 16 is also rotated in the clockwise rotating direction around the first output shaft 15.

On the other hand, when the second reduction gear 22 is rotated in the clockwise rotating direction (normal rotating direction), the output cam 23 is also rotated in the same direction. At this time, the second pin section 27 of the second operation lever 24 enters into a cam groove of the output cam 23, and the second operation lever 24 moves without engaging. Due to the foregoing, torque is not transmitted from the output cam 23 to the second operation lever 24, and the closer output lever 26, which is urged to the neutral position by a pushing force of the return spring, does not move, either.

Figure 3C:
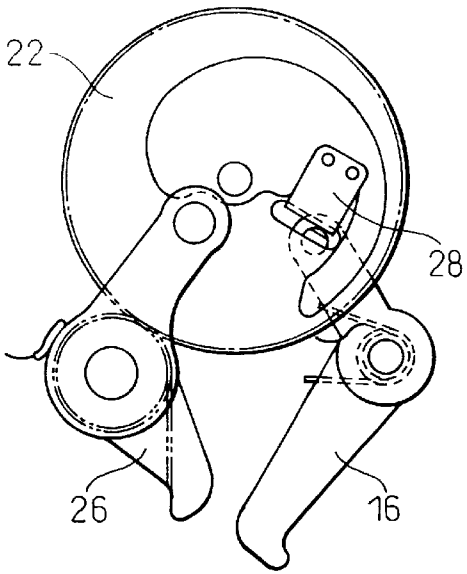
Figure 3B:
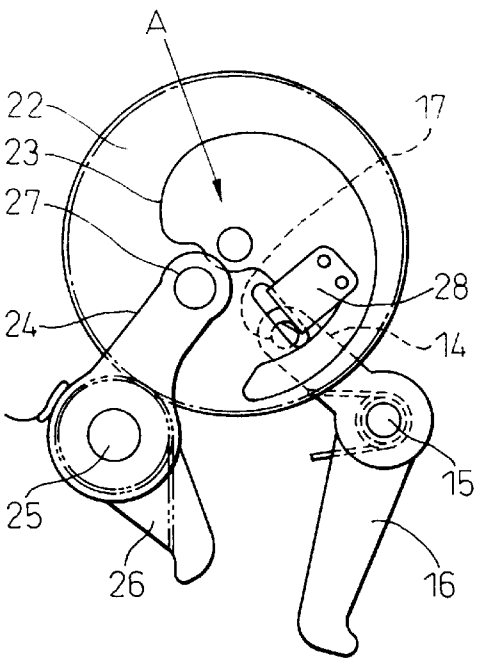
Figure 3A:
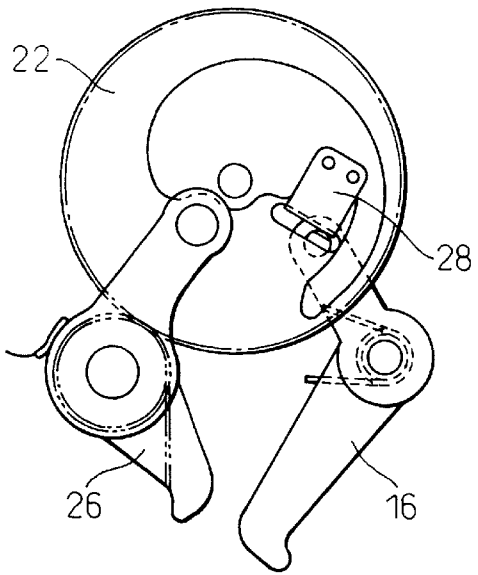

As a result, the unlatch output lever 16 pushes the ratchet 1B, so that the ratchet 1B is moved in the unlatch direction around the support shaft of the ratchet 1B. Therefore, the state of the door lock unit becomes an unlatch state (state in which the door can be opened). This state is shown in FIG. 3B. In this connection, FIG. 3A shows a state before the door is opened (state in which the door is completely closed) which is a step before the state shown in FIG. 3B.

Figure 7A:
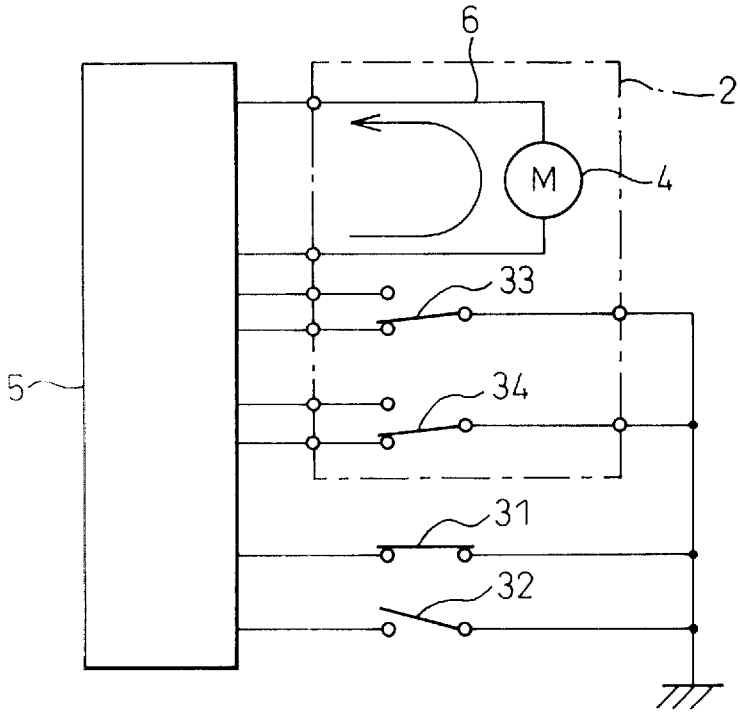
Figure 7B:
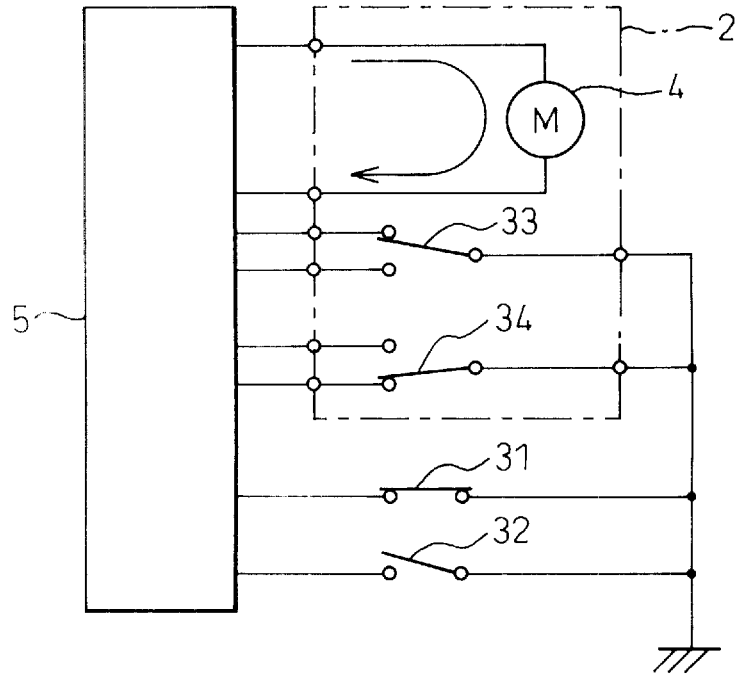

At this moment, when it is detected that the second reduction gear 22 and the engagement member 28 have rotated to an unlatch position, as shown in FIG. 7B, the microswitch (movable contact point) 33 is switched, from a position where it is connected with the neutral position fixed contact point, to a position where it is contacted with the unlatch position fixed contact point. Due to the foregoing, an electric current flows in the direction shown in FIG. 7B in the motor circuit (terminal) 6 of the motor 4, and the motor 4 is rotated in the reverse direction.

The torque of the motor 4 is transmitted to the pinion gear 11 via the elastic body 8 and is further transmitted to the intermediate pinion gear 21 via the pinion gear 11 and the first reduction gear 12. When the second reduction gear 22 and the engagement member 28 are rotated in the counterclockwise rotating direction (reverse rotating direction), the engagement member 28 is rotated in the same direction. Due to the foregoing, the first operation lever 14 and the unlatch output lever 16 are rotated in the counterclockwise rotating direction (reverse rotating direction) around the first output shaft 15 while being pushed by a pushing force of the spring and returned to the neutral position (first neutral point returning means). This state is shown in FIG. 3C.

In this case, when it is detected that the second reduction gear 22 and the engagement member 28 have rotated from the unlatch position to the neutral position, the microswitch (movable contact point) 33 is switched from a position, at which the unlatch position fixed contact point is connected, to a position at which the neutral position fixed contact point is connected. Due to the foregoing, electrific power applied to the motor 4 is stopped.

When a passenger closes the door in an open door state, the engagement pawl for a half latch is engaged with the engagement pawl of the ratchet 1B, and the door enters an incomplete door closing state (half latch state) which is a state in which the door is incompletely closed. When the door has reached this half latch state, the half latch switch 32 is turned on, so that an electric current flows in the motor electrification circuit (terminal) 6 of the motor 4 in the direction shown in FIG. 8A and the motor 4 is rotated in the reverse rotating direction.

The torque of the motor 4 is transmitted to the pinion gear via the elastic body 8 and is further transmitted to the intermediate pinion gear 21 via the pinion gear and the first reduction gear 12. When the second reduction gear 22 and the engagement section 28 are rotated in the counterclockwise rotating direction (reverse rotating direction), the cam face of the output cam 23 comes into contact with the second pin section 27 of the second operation lever 24.

Due to the foregoing, the second pin section 27 is moved outside (outside of the central shaft in the diameter direction) along the cam face, and the second operation lever 24 is rotated around the second output shaft 25 in the clockwise direction in the drawing. Since the second operation lever 24 and the closing output lever 26 are fixed to an outer circumference of the second output shaft 25, when the second operation lever 24 is rotated, the closing output lever 26 is also rotated around the second output shaft 25 in the counterclockwise direction in the drawing.

Figure 5A:
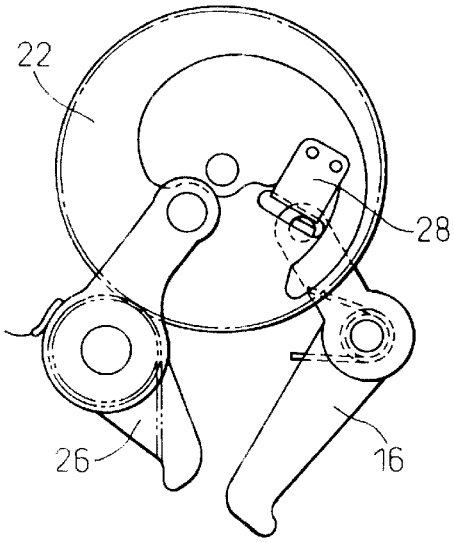
Figure 5B:
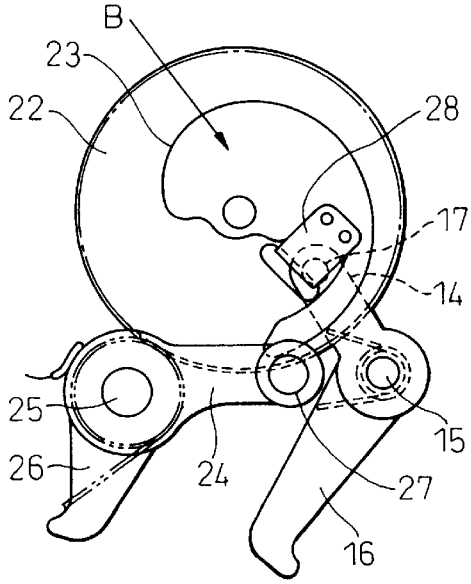

As a result, the closing output lever 26 pushes the latch 1A and moves it in the closing direction around the support shaft of the ratchet 1B. Therefore, the door lock device becomes a full latch state (state in which the door is completely closed). This state is shown in FIG. 5B. In this connection, FIG. 5A shows a state before the door is closed (half latch state) which is a step before the step shown in FIG. 5B.

Figure 8A:
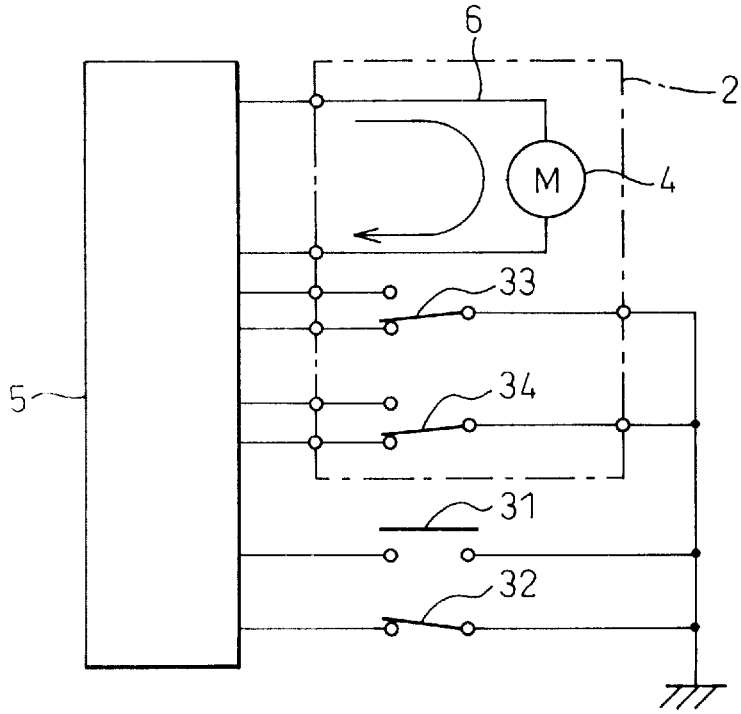
Figure 8B:
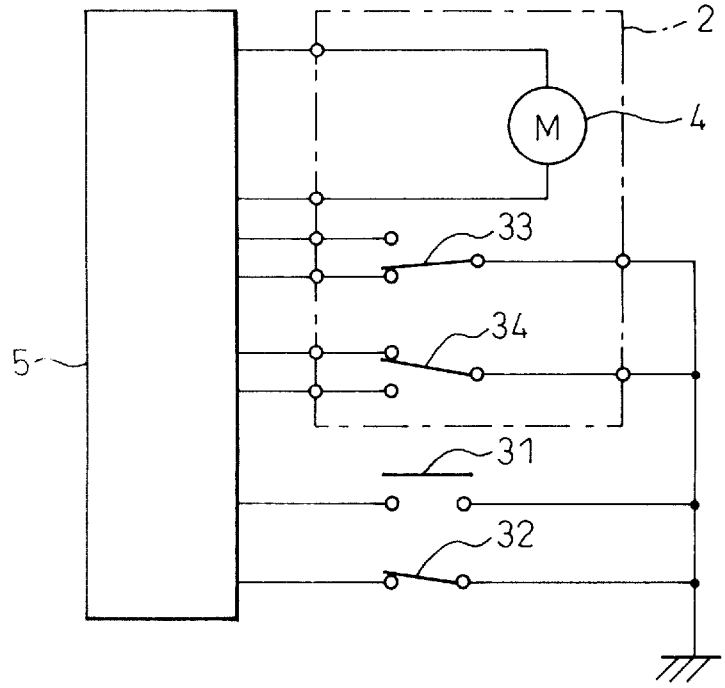

In this case, when the motor is continuously driven and the second reduction gear 22 and the output cam 23 are rotated to the initial positions by one revolution, as shown in FIG. 8B, the microswitch (movable contact point) 34 is switched from a position at which the neutral position fixed contact point is connected, to a position at which the closing position fixed contact point is connected. Due to the foregoing, electrical power applied to the motor 4 is stopped. In this connection, after electrical power applied to the motor 4 has been stopped, the microswitch 34 is switched from a position at which the closing position fixed contact point is connected, to a position at which the neutral position fixed contact point is connected.

Figure 6:
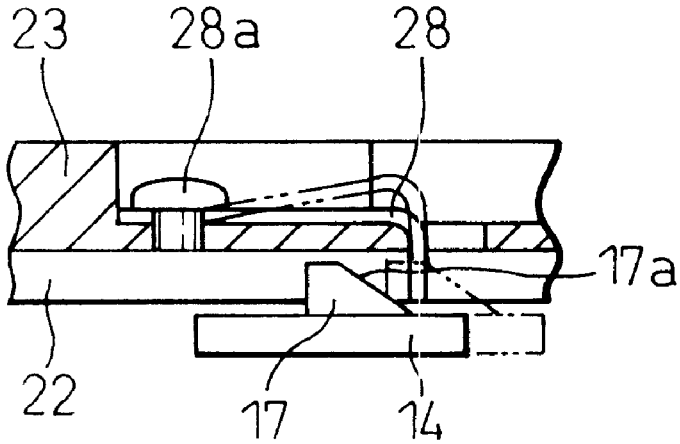
FIG. 6 is a partially cross-sectional view taken in the direction of arrow B in the closing operation schematic illustration shown in FIG. 5B.

When the output cam 23 is rotated from the neutral position by one revolution, the second pin section 27 of the second operation lever 24 enters into the cam groove of the output cam 23 and moves to the inside of the central shaft in the diameter direction (the position shown in FIG. 2), so that the second pin section 27 returns to the neutral position. The second reduction gear 22 and the output cam 23 also return to the neutral position when they rotate by one revolution (second neutral point returning means). Further, the engagement member 28 also returns to the neutral position when it gets over the first pin section 17 of the first operation lever 14. This state in which the engagement member 28 moves over the first pin section 17 is shown in FIG. 6. In FIG. 6, there is shown a state in which the engagement member 28 shown by a broken line is bent and moves over the first pin section 17. FIG. 6 is a partially cross-sectional view taken in the direction of arrow B of the schematic illustration of the closing operation shown in FIG. 5B.

As described above, the door lock drive unit of the present invention operates as follows. The rotating speed of the motor 4 is greatly reduced, at a high reduction ratio, when the first and the second reduction gear having a compact structure are meshed with each other. The unlatch mechanism to conduct an unlatch operation of the ratchet 1B of the door lock 1 and the closing mechanism to conduct the closing operation of the latch 1A of the door lock 1 are separated from each other into the normal and the reverse rotating direction of the second reduction gear. Therefore, even in the middle of the closing operation conducted by the reverse rotation of the second reduction gear, when the closing operation is stopped (the motor 4 is stopped) and the motor 4 is normally rotated, it is possible to switch from the stopping position of the closing operation to the unlatch operation (door opening operation).

Due to the foregoing, both the unlatch function and the closing function can be performed by one motor 4, so that the size of the door lock drive unit can be decreased, and further the door lock drive unit can ensure safety to prevent the occurrence of an emergency in which a finger is pinched by the door.

SECOND EMBODIMENT

Figure 9:
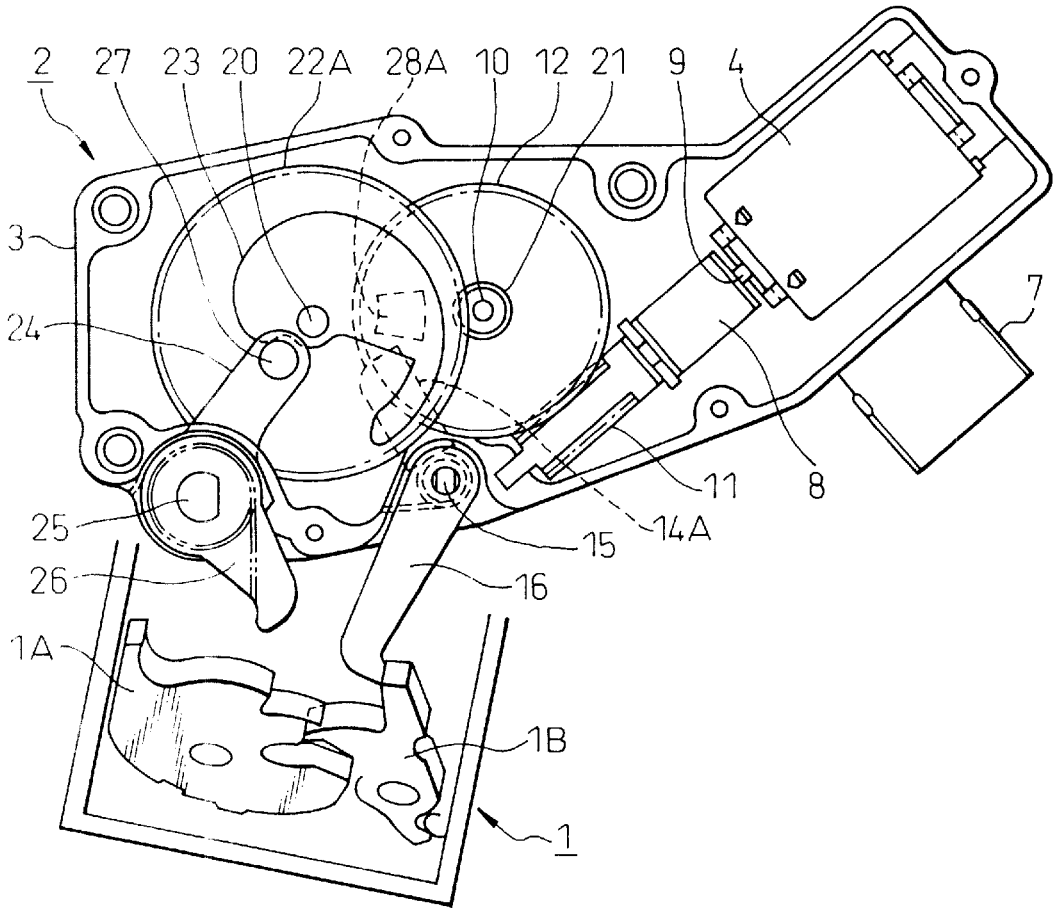
FIG. 9 is a plan view showing a structure of the closing and unlatch actuator of the second embodiment of the present invention.
Figure 10A:
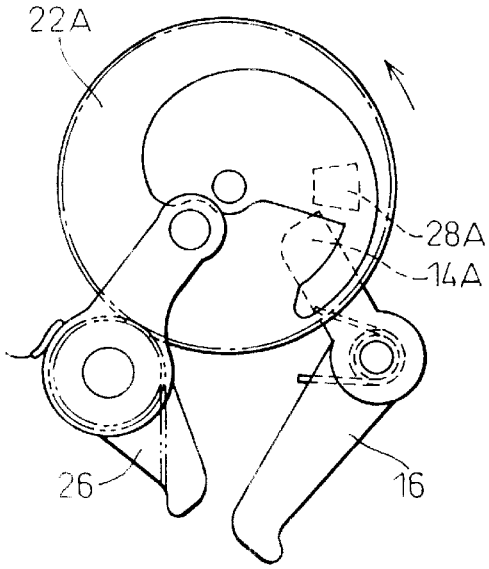
Figure 10B:
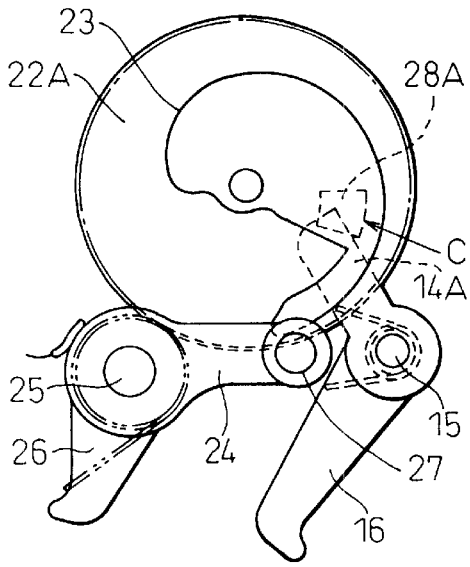
Figure 11:
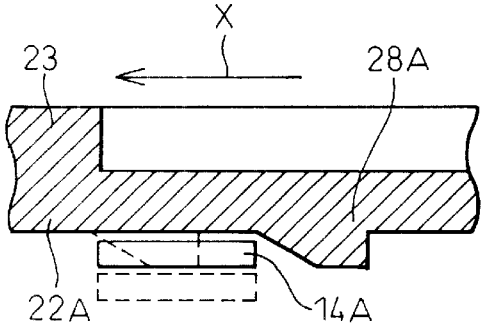
FIG. 11 is a partially cross-sectional view taken in the direction of arrow C in the schematic illustration for explaining the closing operation shown in FIG. 10B.

The door lock drive unit of the second embodiment of the present invention is shown in FIGS. 9, 10 and 11. FIG. 9 is a plan view showing a structure of the closing and unlatch actuator 2 which is the second embodiment of the present invention. FIGS. 10 and 11 are schematic illustrations for explaining the operation of the closing and unlatch actuator 2. Like reference characters are used to indicate like parts in the first and the second embodiment, and the explanations are omitted here. In this connection, the door lock drive unit of the second embodiment explained below is different from that of the first embodiment in the following points. The arrangement of the first operation lever 14, second reduction gear 2 and engagement member 28 shown in the first embodiment is changed from that of the first embodiment, so that the degree of freedom of designing the closing and unlatch actuator 2 is enhanced and the structure is simplified.

As shown in FIG. 9, the output cam 23 is integrally formed on an end face of the second reduction gear 22A, and the engagement member 28A is arranged on an opposite side (back side) of the second reduction gear 22A which is opposite to the side on which this output cam 23 is arranged. To be specific, the engagement member 28A and the second reduction gear 22A are integrated into one body. As described above, when the engagement member 28A and the output cam 23 are respectively arranged on the different end faces on the front and the back side, the space on the front and the back side of the second reduction gear 22A can be effectively utilized and the engagement member 28A and the output cam 23 can be most appropriately arranged in the closing and unlatch actuator 2. The first operation lever 14A is composed of a sheet-shaped spring member made of metal which is an elastic member. Only when the second reduction gear is normally rotated, the first operation lever 14A composed of the elastic member and the engagement member 28A are engaged with each other.

FIGS. 10A and 10B are views showing a state in which the second reduction gear 22A is rotated in the counter-clockwise rotating direction (reverse rotating direction) and the door lock drive unit is changed from a state before the door is closed (state of half latch) shown in FIG. 10A, to a state of full latch (The door is completely closed.) shown in FIG. 10B. When the second reduction gear 22A is rotated in the reverse rotating direction as described above, the first operation lever 14A composed of the elastic member is bent as shown in FIG. 11 (shown by the broken line 14A in FIG. 11). Therefore, the first operation lever 14A is prevented from engaging with the engagement member 28A.

In the first embodiment, in order to transmit the torque of the second reduction gear 22 in the normal rotating direction to the first operation lever 14, the door lock drive unit is composed of components including the second reduction gear 22, engagement member 28, first operation lever 14 and first pin section 17. On the other hand, in this embodiment, the door lock drive unit is only composed of components including: the second reduction gear 22A integrated with the engagement member 28A; and the first operation lever 14A composed of an elastic member. Therefore, it is possible to provide a door lock drive unit at a low cost in which the number of parts is decreased.

In this connection, explanations are made for a case in which the present invention is applied for a door lock drive unit used for a vehicle such as an automobile, however, the present invention may be applied to a door lock drive unit used for a vehicle other than an automobile, and may also applied to a door lock drive unit of an airplane or a ship. Also, the present invention may be applied to a door lock drive unit used for a house, factory or shop in which both the unlatch function and the closer function are performed.

In the embodiment of the present invention, two steps of the first and the second reduction gear are provided. However, according to the desired operation torque of the first and the second output lever, it is possible to adjust a ratio of reduction only by the first reduction gear, or alternatively the third reduction gear (not shown) may be provided, if necessary, so as to reduce the size of the door lock drive unit.

Further, in the embodiment of the present invention, it is possible to effectively utilize space in the actuator case 3 by freely arranging the output cam 23 and the engagement members 28, 28A, which are arranged on an end face of the second reduction gear 22, on either the front side or the back side of the second reduction gear 22.

In the first embodiment of the present invention, the engagement member 28 made of metallic spring material is separately arranged on an end face of the second reduction gear 22 made of resin. However, the engagement member 28 and the second reduction gear 22 may be formed by integral resin molding. In this case, a profile of the engagement member 28 made of resin is devised so that an elastic force can be provided by the engagement member 28. Alternatively, the engagement member 28 and the second reduction gear 22 may be integrally made of metal.

In the first embodiment of the present invention, the first pin section 17, the profile of which is substantially a column, is formed at an end of the first operation lever 14 made of resin by integral molding. However, the first pin section 17 may be separately made of metallic material and joined to the first operation lever 14. Alternatively, the first operation lever 14 and the first pin 17 may be integrally made of metal.

The invention has been described by reference to specific embodiments chosen for purposes of illustration but it should be apparent that numerous modifications could be made thereto, by those skilled in the art, without departing from the basic concept and scope of the invention.

What is claimed is:

1. A door lock drive unit comprising:

a door lock in which an open door is closed from an open door state to a closed door state via a half latch state or a full latch state, and a closed door is opened from the closed door state to the open door state via an unlatch state;

an unlatch mechanism to drive the door lock from the full latch state to the unlatch state when the unlatch mechanism is driven by a motor;

a closing mechanism to drive the door lock from the half latch state to the full latch state;

a gear rotated by the motor in a normal and a reverse rotating direction; and a cam fixed to the gear, the cam driving the closing mechanism when the gear is rotated in the reverse rotating direction from an initial state of the closing mechanism, the cam returning the closing mechanism to the initial state within one revolution of the gear in the reverse rotating direction; and an engagement member provided in the gear or the cam, the engagement member being capable of engaging with the unlatch mechanism when the closing mechanism is in the initial state, the engagement member being capable of transmitting a drive force of the motor to the unlatch mechanism only when the gear is normally rotated from a state in which the engagement member is capable of engaging with the unlatch mechanism.

2. A door lock drive unit according to claim 1, wherein the engagement member is composed of an elastic member.

3. A door lock drive unit according to claim 1, wherein:

the unlatch mechanism comprises a first output shaft for driving the door lock to the unlatch state when the gear is rotated in the normal rotating direction and when the engagement member transmits the drive force to the unlatch mechanism; and the closing mechanism comprises a second output shaft for driving the door lock to the closing state, wherein the second output shaft is not driven while the engagement member transmits the drive force to the unlatch mechanism.

4. A door lock drive unit according to claim 1, wherein when the gear is rotated in the normal rotating direction, torque is not transmitted from the cam to the closing mechanism.

5. A door lock drive unit according to claim 1, further comprising a control circuit for controlling electrical power supplied to the motor, the control circuit including:

a door opening switch for detecting the open door state;

a half latch switch for detecting the half latch state;

a closing switch for detecting a rotational status of the gear and the cam; and a microcomputer for controlling each of the door opening switch, half latch switch and closing switch to selectively supply electrical power to the motor for rotating the motor in the normal and reverse rotating directions.

6. A door lock drive unit according to claim 1, wherein the unlatch mechanism includes a tapered and an untapered section, the untapered section engages with the engagement member when the gear is normally rotated, and the tapered section prohibits the unlatch mechanism from engaging with the engaging member when the gear is rotated in the reverse rotating direction.

7. A door lock drive unit according to claim 6, wherein the engagement member is composed of an elastic member.

8. A door lock drive unit according to claim 1, wherein the unlatch mechanism includes sheet shaped spring member made of metal, and the sheet shaped spring member is arranged at a position capable of engaging with the engagement member.

9. A door lock drive unit according to claim 8, wherein the cam includes a circumferential section, the radius of which is gradually increased when the gear is rotated in the reverse rotating direction.

10. A door lock drive unit according to claim 1, wherein:

the unlatch mechanism includes a sheet shaped spring member made of metal;

the engagement member includes a tapered and an untapered section; and the untapered section engages with the sheet shaped spring member when the gear is normally rotated, and the tapered section prevents the sheet shaped spring member from engaging with the engagement member when the gear is rotated in the reverse rotating direction.

11. A door lock drive unit according to claim 10, wherein the cam includes a circumferential section, the radius of which is gradually increased when the gear is rotated in the reverse rotating direction.

12. A door lock drive unit according to claim 1, wherein the cam is substantially semicircular.

13. A door lock drive unit according to claim 12, wherein the unlatch mechanism includes a tapered and an untapered section, the untapered section engages with the engagement member when the gear is normally rotated, and the tapered section prohibits the unlatch mechanism from engaging with the engaging member when the gear is rotated in the reverse rotating direction.

14. A door lock drive unit according to claim 13, wherein the engagement member is composed of an elastic member.

15. A door lock drive unit according to claim 12, wherein:

the unlatch mechanism includes a sheet shaped spring member made of metal;

the engagement member includes a tapered and an untapered section; and the untapered section engages with the sheet shaped spring member when the gear is normally rotated, and the tapered section prevents the sheet shaped spring member from engaging with the engagement member when the gear is rotated in the reverse rotating direction.

16. A door lock drive unit, according to claim 15, wherein the cam includes a circumferential section, the radius of which is gradually increased when the gear is rotated in the reverse rotating direction.

17. A door lock drive unit according to claim 12, wherein the cam includes a circumferential section, the radius of which is gradually increased when the gear is rotated in the reverse rotating direction.

* * * * *